United States Patent [19]

Carson

[11] 4,270,695

[45] Jun. 2, 1981

[54] UNDERGROUND SERVICE MODULE

[76] Inventor: Miles T. Carson, 2390 W. Dartmouth at S. Zuni, Englewood, Colo. 80110

[21] Appl. No.: 62,021

[22] Filed: Jul. 30, 1979

Related U.S. Application Data

[63] Continuation-in-part of Ser. No. 968,790, Dec. 12, 1978.

[51] Int. Cl.[3] ..... F24D 1/04

[52] U.S. Cl. ..... 237/12.1; 165/47; 165/51; 165/DIG. 12

[58] Field of Search ..... 165/41, 47, 51, 42, 165/43, 39, 23, DIG. 12; 98/39; 237/12.1; 60/727; 122/26; 126/247; 417/539

[56] References Cited

U.S. PATENT DOCUMENTS

| | | | |
|---|---|---|---|
| 3,610,524 | 10/1971 | Wallen | 237/12.1 |
| 3,672,445 | 6/1972 | Carson | 165/42 |
| 3,799,244 | 3/1974 | Strauss et al. | 165/23 |
| 3,964,458 | 6/1976 | Strauss et al. | 165/41 X |

*Primary Examiner*—Albert W. Davis
*Assistant Examiner*—Margaret A. Focarino
*Attorney, Agent, or Firm*—Kerkam, Stowell, Kondracki & Clarke

[57] ABSTRACT

A self-contained service module incorporates a water cooled internal combustion engine as a primary power source which drives a low-pressure, high volume forced air ventilation system; a water cooled, high-pressure air compressor; and an alternator. Large diameter steel tubing is utilized as a basic framework for the system and provides a dual function by supporting the primary components of the system and by serving as a reservoir for the high-pressure air. A heat exchange radiator is provided to remove heat from the engine and air compressor cooling liquid and heat the low-pressure air in the ventilation system. When heated air is not required, the radiator is moved to a second position so that air passing therethrough is exhausted from the unit and fresh air at ambient temperatures is provided by the ventilation system.

9 Claims, 10 Drawing Figures

UNDERGROUND SERVICE MODULE

CROSS REFERENCE TO RELATED APPLICATION

This application is a continuation-in-part of my copending application Ser. No. 968,790, filed Dec. 12, 1978, and entitled, UNDERGROUND SERVICE MODULE.

TECHNICAL FIELD

This invention relates to a module for servicing closed working areas such as manholes by providing ventilating and heated and ventilating air for the workmen and compressed air and electrical power for operating tools.

BACKGROUND OF PRIOR ART

In our urban society a majority of utilities are routed via underground conduits. Access to the conduits is provided at key locations by way of manholes whereby workmen may descent into the conduits and repair or add utility facilities. This work is normally time consuming and the workmen must remain in the underground conduits for extended periods of time. The conduits are not ventilated and therefore noxious and poisonous gases may accumulate therein and create an atmosphere which is hazardous to their health. Therefore, it has been a practice to provide ventilating air to a manhole by way of a small, portable, engine driven squirrel cage type fan. These fans are usually carried by service trucks when not in use and deployed by placing them on the ground adjacent to the manhole being serviced. This results in the fan scavenging noxious gases from the surface, such as exhaust fumes from the engine driving the fan, and forcing them into the area being serviced where they contribute to the unhealthy atmosphere rather than improve it. Furthermore, this air can be extremely cold in the winter and hamper the servicemen. This is overcome by attaching a propane heater to the blower fan housing. This provides heated air but it creates logistics problems in setting up the bulky heating equipment and fuel source near the manhole in an area which may be a crowded city street.

Servicemen working in underground conduits require compressed air and electricity to drive their tools and provide a means to illuminate the work area. This is usually supplied by an air compressor and electrical generator, both of which are positioned on the surface near the manhole. This results in a large amount of equipment deployed about a manhole and creates significant traffic disruptions. Furthermore, the time required to deploy the various components required to service workmen in a manhole greatly increases the cost for accomplishing a predetermined job in a conduit.

These drawbacks have been partially overcome by systems such as that disclosed in U.S. Pat. No. 3,672,445 issued to T. Carson on July 27, 1972. This patent discloses a truck mounted system which utilizes the prime mover driven generator to provide electric power for an electrically driven air compressor and high-volume low-pressure air ventilation system. The Carson system also includes a heat exchanger wherein hot water from the truck engine heats the ventilating air supplied via the low-pressure, high-volume portion of the system.

Truck mounted systems such as Carson U.S. Pat. No. 3,672,445 must be permanently installed in the vehicle due to the water and electrical interconnections between the system and the vehicle engine. Therefore a truck must be designated as a manhole service truck and this results in a significant capital expenditure for each manhole support service system. Operation of the system is also uneconomical because it requires that the engine of the truck be run constantly while the service module is in operation.

This is costly not only in fuel consumed but also in the useful life of the truck engine since it is being operated in an environment for which it was not originally designed.

An underground service module presented in copending U.S. patent application Ser. No. 968,790, filed Dec. 12, 1978, in the name of Miles T. Carson has solved many of the problems existing in prior art service systems. However, the underground service module disclosed in the copending patent application while providing many needed features, fails to permit adjustment of air volume and mean air temperature in the conditioned air circuit. That system also fails to include safety features which will permit remote control of the conditioned air and the heat exchange systems are not optimized for maximum efficiency.

OBJECTIVES OF THE INVENTION

In view of the preceding, it is a primary objective of the present invention to provide a self-contained service module which includes a water cooled internal combustion engine adapted to drive a water cooled air compressor, a ventilation fan, and an alternator.

A further objective of the present invention is to provide a means whereby ventilation air may be heated by the waste heat of the internal combustion engine and air compressor of a self-contained underground service module.

A still further objective of the present invention is to provide a means whereby the radiator of a self-contained underground service module may be positioned in or out of the ventilation air supply system as required by environmental conditions.

Another objective of the present invention is to provide a self-contained underground service module which is light in weight and may be transported by a variety of vehicles, off loaded by hand and positioned near a manhole being serviced to free the transportation vehicle for other duty. The small size of the unit also permits mounting the unit, either temporarily or permanently on a small, relatively light weight trailer.

It is another objective of the present invention to provide a dual purpose framework for a service module which supports the components thereof and serves as a high-pressure air storage container.

A still further objective of the present invention is to provide a heat exchange radiator for extracting heat from the cooling fluids utilized by an internal combustion engine and air compressor of a service module which may be positioned in the ventilating air plenum when heated ventilated air is required or positioned outside of the ventilating air plenum when heated ventilating air is not required.

A still further objective of the present invention is to provide a liquid cooled muffler and an exhaust gas heat exchanger for the internal combustion of a service module whereby heat extracted from the exhaust gases of the internal combustion engine may be utilized to heat ventilating air supplied by the system.

Another objective of the present invention is to provide a means whereby air volume in an underground service module may be reduced so that the mean air temperature exiting a heat exchanger will be increased.

A still further objective of the present invention is to provide a worm gear drive for a heat exchange radiator in an underground service module whereby the heat exchange radiator may be positioned in the conditioned air circuit of an underground service module or in a bypass circuit through the use of remotely located electrical switches.

A further objective of the present invention is to provide an automatically controlled heat exchange baffle for an underground service module whereby exhaust gases are caused to bypass a heat exchanger when the coolant of the heat exchanger exceeds a predetermined temperature.

SUMMARY OF THE INVENTION

The present invention comprises an underground service module which is self-contained and may be transported in a variety of vehicles to a work site where it will provide conditioned air to an underground utilities conduit and compressed air and electrical power for tools, service equipment and illumination means. The module includes a water cooled internal combustion engine which drives an alternator and water cooled air compressor by way of belt drives. The three primary components, internal combustion engine, air compressor and alternator are supported on a framework fabricated from steel tubing which functions as a compressed air reservoir.

The low-pressure conditioned air for ventilating underground conduits being serviced is generated by a blower encased in a voluted plenum constructed so that the pressure within the plenum is greater than the ambient environmental pressure to prevent exhaust fumes or objectionable gases from entering the supply of conditioned air. The plenum is split, with one portion channeling conditioned air to the service area and the other portion exhausting surplus air from the bottom of the module. The heat exchanger for extracting heat from the cooling fluid of the internal combustion engine and air compressor is positioned so that it may be placed in the plenum so that the air going to the service area must pass therethrough whereby it is heated or if it is not desirable to heat the ventilating air, the heat exchanger may be moved to an alternate position wherein the surplus air exiting the module passes through the heat exchanger to extract heat from the cooling fluid therein without adding to the heat of the conditioned air provided to the service area.

The high-pressure air and electric power generated by the system is coupled to the service area by way of high-pressure hoses and electrical cables which are stored on reels driven by an electric motor to overcome prior art storage means which utilize spring biased reels that have a tendency to wind up the cables and hoses when it is wished that they be deployed. Spring loaded reels are considered to be an unacceptable safety hazard by many customers.

BRIEF DESCRIPTION OF THE DRAWINGS

FIG. 5 is a side view of the underground service module illustrating the centrifugal fan conditioned air circuit.

FIG. 10 is a schematic diagram of the electrical supply circuit.

DESCRIPTION OF THE INVENTION

Figure 1:
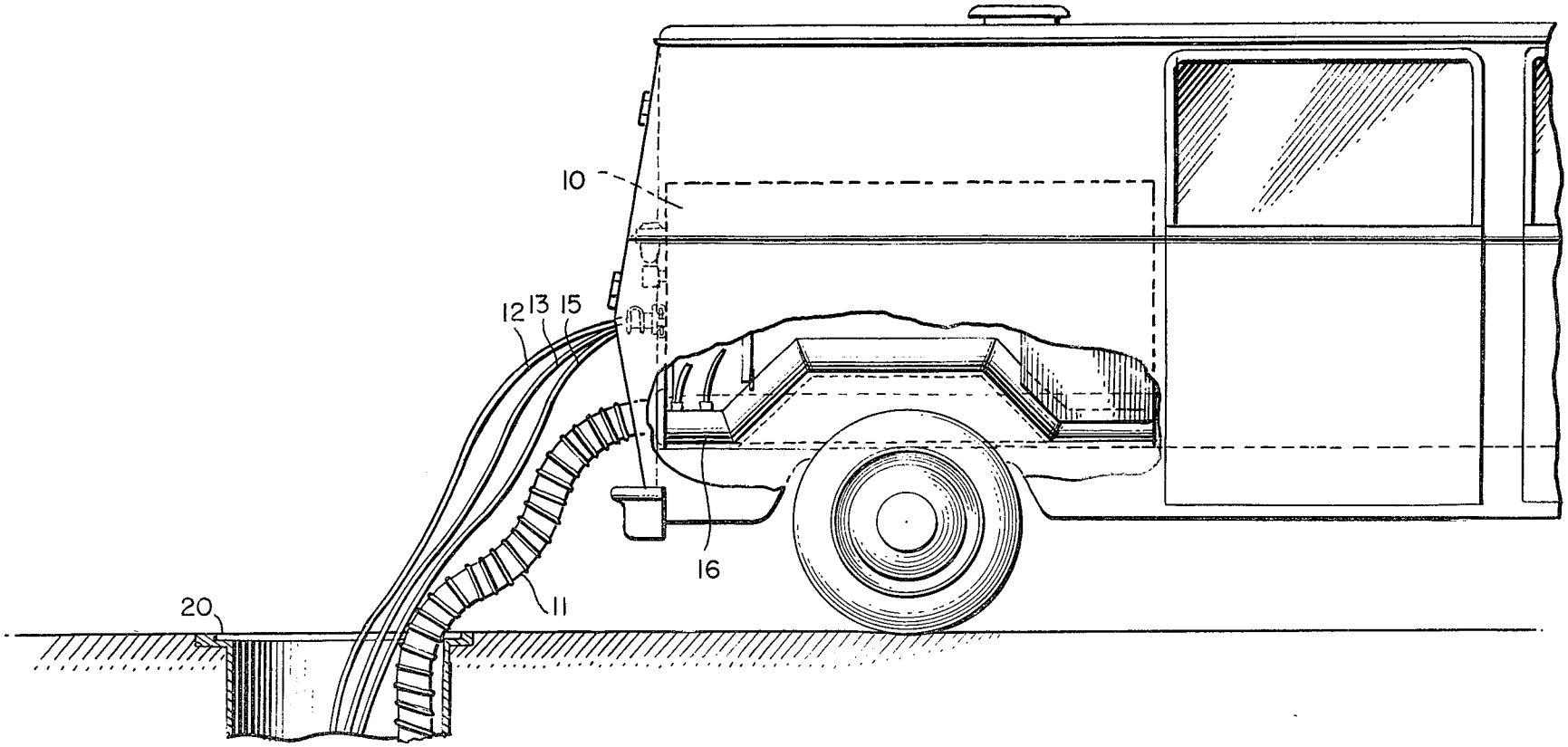
FIG. 1 illustrates the underground service module positioned in the rear of a truck with the conditioned air conduit entering a manhole.

FIG. 1 illustrates the underground service module 10 within a truck and deployed alongside a manhole 20. The service model is designed so that it may function within the truck or be placed on the ground alongside the manhole to free the truck for other service. Conditioned ventilating air is supplied to the manhole by collapsible duct 11 and pressured air is made available at work area by high and low pressure air hoses 12 and 13, respectively. Electrical current provided by the alternator of the service module is available on electrical extension 15 which is terminated by a multi outlet receptacle.

Figure 3:
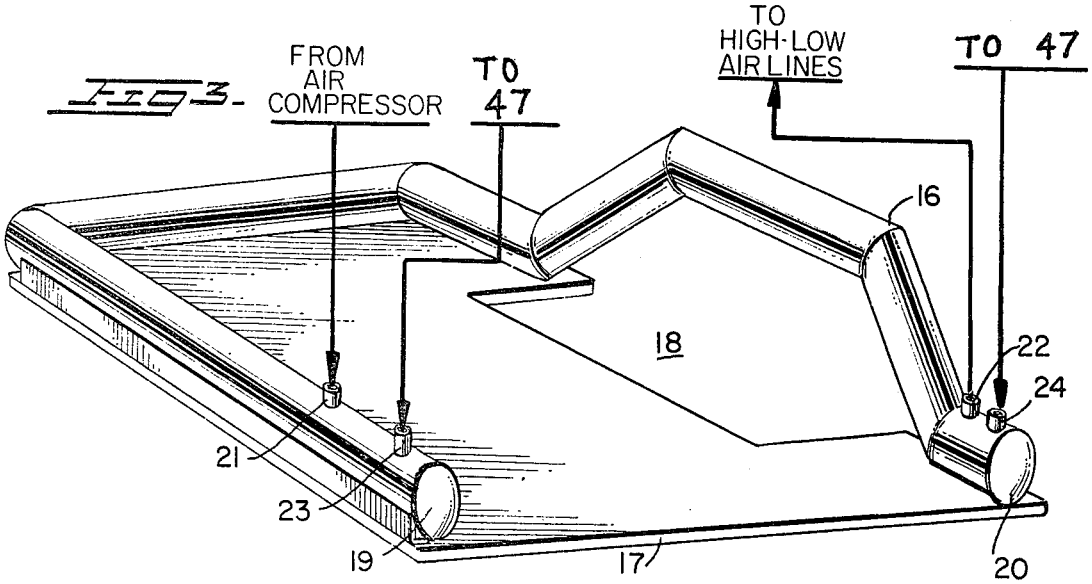
FIG. 3 is a perspective view of the combined high-pressure air storage system and module frame.

In the cutaway portion of FIG. 1 note that the side frame member 16 is configured to fit around the truck wheel well. This may be seen more clearly in FIG. 3 which illustrates the complete chasis frame 16 mounted on the service module bottom pan 17. Note that the bottom pan includes a cutout portion 18 dimensioned to accommodate a truck wheel well.

The underground service module frame 16 is fabricated from a 14 gauge steel duct 5" in diameter. It is sealed by end caps 19 and 20 to form a high pressure air reservoir. This reduces the weight and size of the service module by eliminating the need for high pressure tanks. The 5" diameter dimensions are chosen to simplify production of the unit because pressure vessels less than 6" in diameter do not come within Federal Code Requirements. The primary frame or high pressure air reservoir 16 includes a high pressure inlet fitting 21 which couples high pressure air from the air compressor and a high pressure outlet fitting 22 which provides a means to couple the high pressure air reservoir to the high and low air line system. Fittings 23 and 24 are outlet fittings to allow removal of condensate which normally accumulates in pressure vessels. Automatic tank drain 47 is a conventional type valve that opens momentarily when actuated by the compressor unloader.

Figure 2:
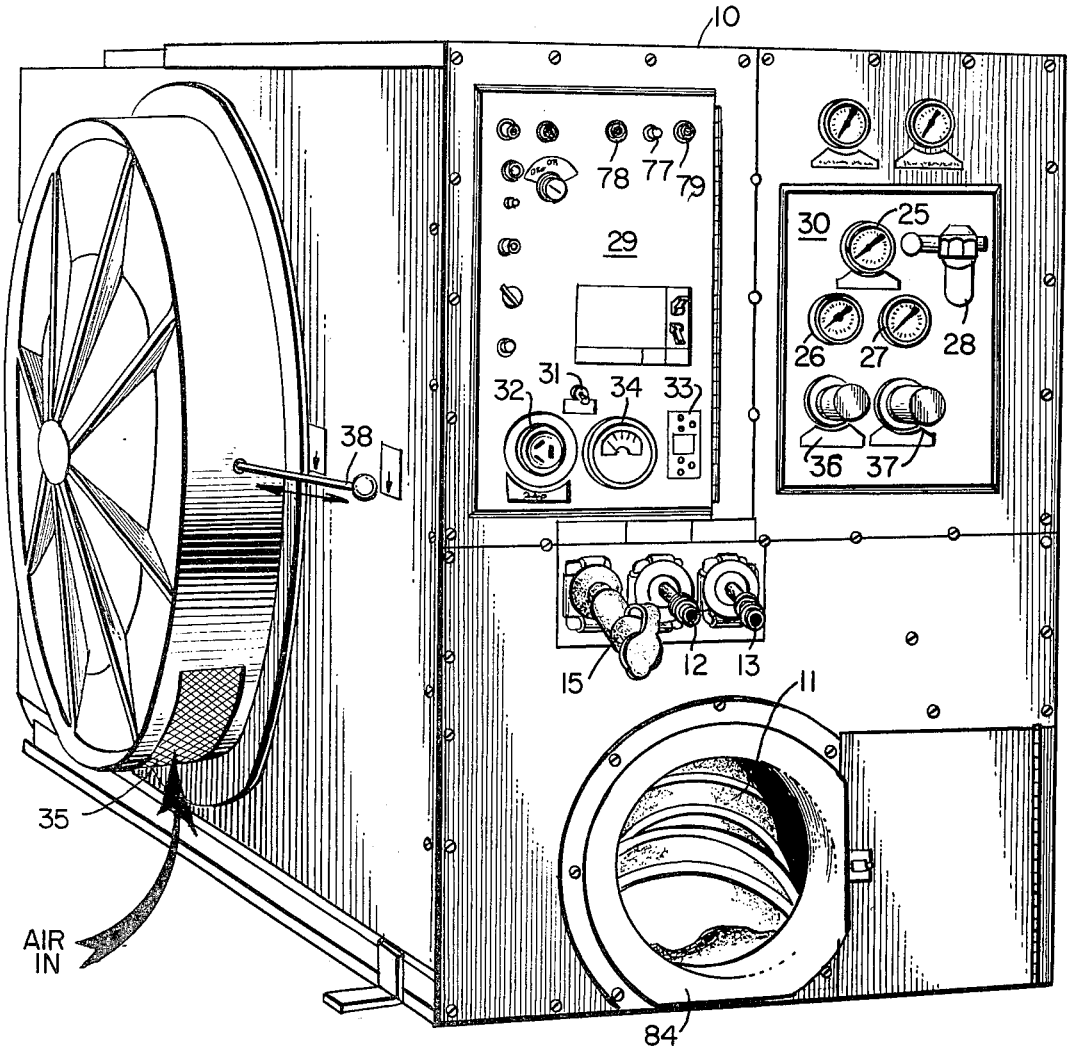
FIG. 2 is a perspective view of the underground service module illustrating the control panels, air and power outlets and centrifugal fan housing.

FIG. 2 illustrates the underground service module as it appears when deployed from the truck. In this figure, the electrical extension 15, high pressure air line 12 and low pressure air line 13 are retracted on their respective reels and the low pressure air duct 11 is collapsed into its storage area which is the outlet section of the conditioned air plenum. High and low pressure air controls the gauges are located on panel 30 which contains the high pressure reservoir pressure indicator 25, the low pressure indicator 26 and control 36 and the high pressure indicator 27 and control 37. Also contained on panel 30 is the pilot dryer 28, which indicates effectiveness of large dryer 55.

The engine control and alternator control panel 29 is located to the left of the pressurized air control panel 30. This panel includes the engine controls and indicators and the electrical power output controls and indicators. For instance, along the bottom of the panel note the alternator control switch 31, three phase receptacle 32 and single phase outlet receptacles 33 positioned around voltmeter 34.

The amount of air drawn through the air inlet 35 of the conditioned air blower is controlled by lever 38 to regulate the air flow through the system.

Figure 8:
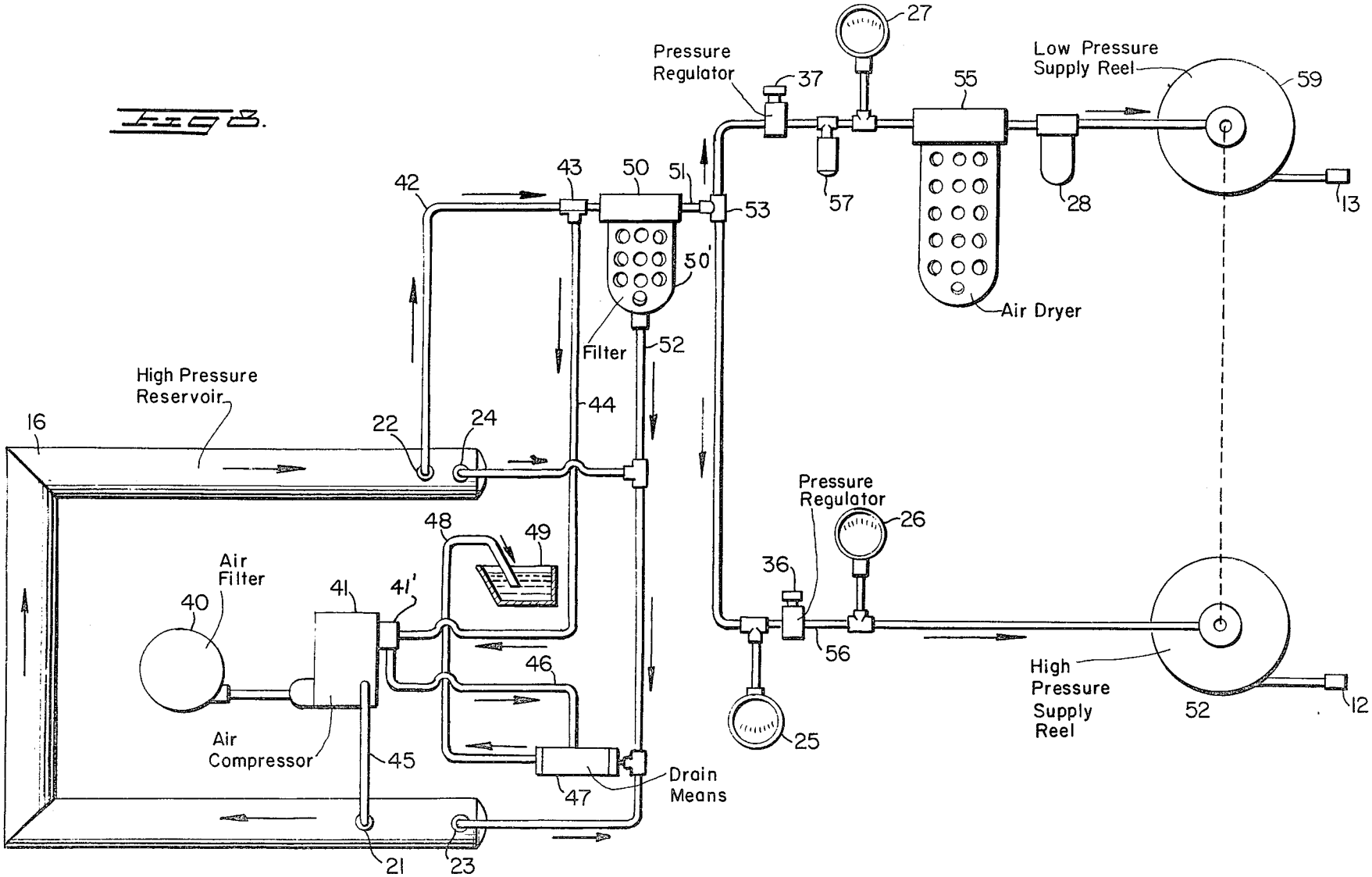
FIG. 8 is a schematic diagram of the high and low pressure air systems.

FIG. 8 is a stylized schematic diagram of the pressurized air subsystem which illustrates the inter-relationship of the various components comprising the subsystem. The actual physical location of the various elements may be found to FIGS. 1, 2, 3, 4, 5, and 6 wherein like reference designators indicate identical parts.

In FIG. 8, the air compressor 41 provides a flow of high pressure air to the high pressure air reservoir 16. Air for the compressor 41 is derived from air filter 40 which also cleans the air for the internal combustion engine. The compressed air from the compressor 41 is stored in the high pressure tank 16. Air from the tank 16 passes via line 42 to the filter 50 contained in a plastic housing shielded by a perforated cover 50'. Fifty-two (52) designates a drain line which removes filtered contaminates via the tank drain 47, line 48 and container 49. A portion of the high pressure air passes via line 44 to air compressor unloader 41' which holds the compressor intake valve open and actuates the drain means 47 via line 46. Some oil and moisture also condenses in the high pressure vessel 16, and it is removed via the drain tank 47 and outlet fittings 23 and 24 associated with the high pressure tank 16 as hereinbefore described.

The high pressure air conduit 51 leaving filter 50 is coupled to a "T" 53 which provides pressurized air to the low pressure and high pressure systems. Pressure gauge 25 monitors the pressure in this line which is an indication of the pressure within the reservoir 16. A pressure regulating valve 36 regulates the air pressure in conduit 56 which forms the high pressure supply to the high pressure air line 12 via the rotary air fitting in the high pressure supply reel 52. The pressure in the high pressure supply line conduit 56 is monitored by air pressure meter 26.

The pressurized air at "T" 53 is also applied through pressure regulator 37 to the low pressure system. The low pressure system includes a low pressure safety pop valve 57, a pressure gauge 27, a dessicant dryer 55 and a pilot dryer 28. The low pressure air supply is coupled via a rotary low pressure air fitting in the low pressure reel 59 to the low pressure line 13.

Figure 6:
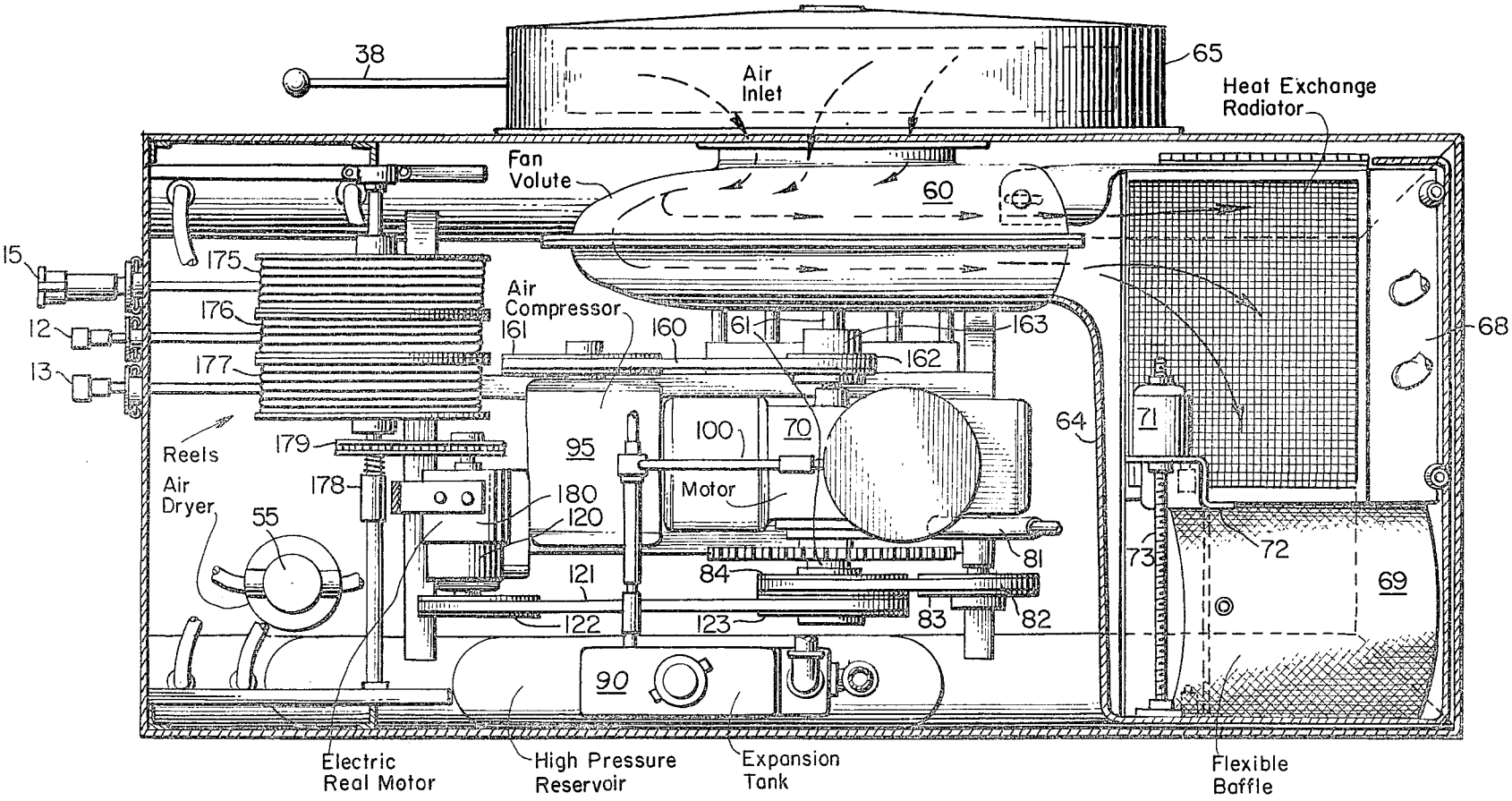
FIG. 6 is a top view with the top panel removed and the conditioned air duct partially cut away to illustrate the heat exchange transport mechanism.
Figure 7:
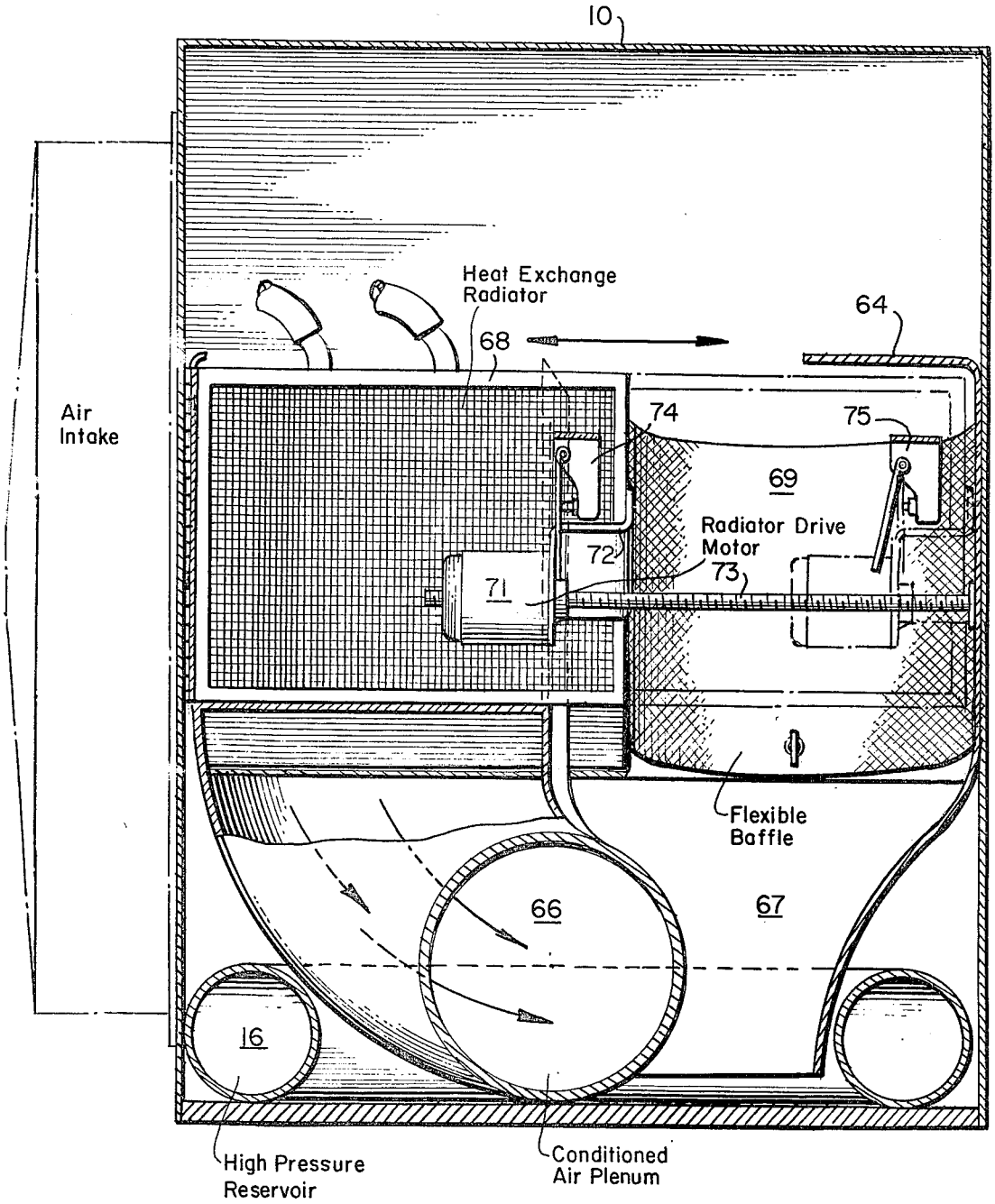
FIG. 7 is an end cutaway view of the underground service module illustrating the heat exchange transport mechanism.

Conditioned air is provided by the service module by drawing ambient air in through air inlet 35 of FIG. 2 and discharging it through conduit 11. Conditioned air flow through the service module may best be traced with the aid of FIGS. 5, 6, and 7. In FIG. 6, air enters through the air inlet control means 65 in a volume which is controlled by the air inlet positioning arm 38. Air is drawn through inlet 65 by a centrifugal fan located within volute 60. The fan is driven by shaft 61 which is coupled directly to the crank shaft of engine 70. FIG. 5 is a side view with the air inlet 65 removed so that the outer half of the volute 60 and fan impeller 62 may be seen. Air from the centrifugal blower flows out of volute 60 into chamber 64 which, as can be seen in FIG. 6 extends the full width of the service module and functions to channel air through the conditioned air plenum 66 or the exhaust plenum 67 as a function of temperature requirements of the conditioned air, see FIG. 7. The flow of air out of chamber 64 is controlled as a function of the position on the heat exchange radiator 68 and flexible baffle 69. In FIGS. 6 and 7 the heat exchange radiator is illustrated in the maximum heat position. Air entering chamber 64 from plenum 60 flows through the radiator 68 to the conditioned air plenum 66 and flexible baffle 69 blocks the exit from chamber 64 via exhaust duct 67 so that practically all of the air exiting the centrifugal blower passes through heat exchanger 68 and into the conditioned air plenum 66. An electric motor 71 is fastened to heat exchanger 68 by a bracket 72 and coupled to the side of the service module by a worm gear drive including threaded shaft 73. Motor 71 is an electric motor which may be rotated in either direction to cause heat exchanger 68 to move back and forth between the position illustrated in FIG. 7 and the position illustrated in phantom line FIG. 7. When the heat exchanger 68 is positioned as shown in phantom in FIG. 7, the air flow out of plenum 60 is divided. One half flows through conditioned air plenum 66 at ambient temperature since it does not flow through the heat exchanger 68 and the other half of the flow from the centrifugal blower flows through heat exchanger 68 and exits the unit via exhaust duct 67. Heat exchanger 68 may be positioned at any point within chamber 64 so that the ratio of heated air to unheated air entering conditioned air duct 66 may be controlled to control the temperature of the conditioned air. Fuller temperature adjustments of the conditioned air is obtained by controlling the total volume of air flowing through the system as a function of control arm 38 and air inlet 65.

The motor 71 which controls positioning of heat exchanger 68 is protected by limit switches 74 and 75 which shut the motor off when it drives to the extreme left or right position as illustrated in FIG. 7. Limit switches 74 and 75 are microswitches which are normally closed so that when the heat exchanger is driven to the extreme left position as indicated in FIG. 7, microswitch 74 is activated and the circuit to motor 71 is open. This electrical circuit is illustrated in the schematic of FIG. 10 in the lower left hand corner. Note that motor 71 will rotate clockwise or counterclockwise as a function of the positioning of gang switch 77. The physical location of the ganged switch 77 is on panel 29 of FIG. 2. In FIG. 2 note that left and right indicator lamps 78 and 79 are positioned at either side of toggle switch 77. As can be seen in FIG. 10, these lights indicate the direction of current flow through motor 71 and thus the direction of travel of heat exchanger 68.

With the heat exchanger positioned as illustrated in FIG. 7, limit switch 75 of FIGS. 7 and 10 will be closed and limit switch 74 would be open. If the toggle switch 77 were pushed up to close the circuit for driving the heat exchanger further left, current flow would be through the A section of gang switch 77 of FIG. 10 to the open limit switch 74 and there would be no lamp indication at 78 or 79 and the motor 71 would not be energized. However, if gang switch 77 were placed in the opposite position, current flow from the A section would be through the normally closed limit switch 75 to motor 71 and heat exchanger 68 would be transported to the right. Current would also flow in parallel with motor 71 through lamp 79 via the B contacts of gang switch 77 to provide a visual indication of motor operation. If switch 77 is held in this position, motor 71 will transport the heat exchanger across the full width of the service module until limit switch 75 is depressed. This action opens limit switch 75 and breaks the path of current through motor 71 and indicator lamp 79. It should be noted that as soon as the heat exchanger 68 began its movement to the right, limit switch 74 closes so that the motor may be engerized to rotate in the opposite direction by placing switch 77 in the transport left position.

The cutaway view of FIG. 5 illustrates the storage provisions included in the conditioned air plenum outlet duct 80. The conditioned air duct 11 is coupled to a sliding adapter 81 which includes a pair of sealing rings 82 and 83 dimensioned to provide an air tight seal between adapter 81 and the walls of duct 80 but permit the adapter to slide back and forth within the duct so that the conditioned air duct 11 may be stored in duct 80 by forcing the duct 11 into duct 80 which moves adapter 81 into duct 80. When the flexible, collapsible duct 11 is extracted from duct 80, adapter 81 will slide to the extreme right side of the duct but be prevented from coming all the way out of the duct by flange 84.

Figure 9:
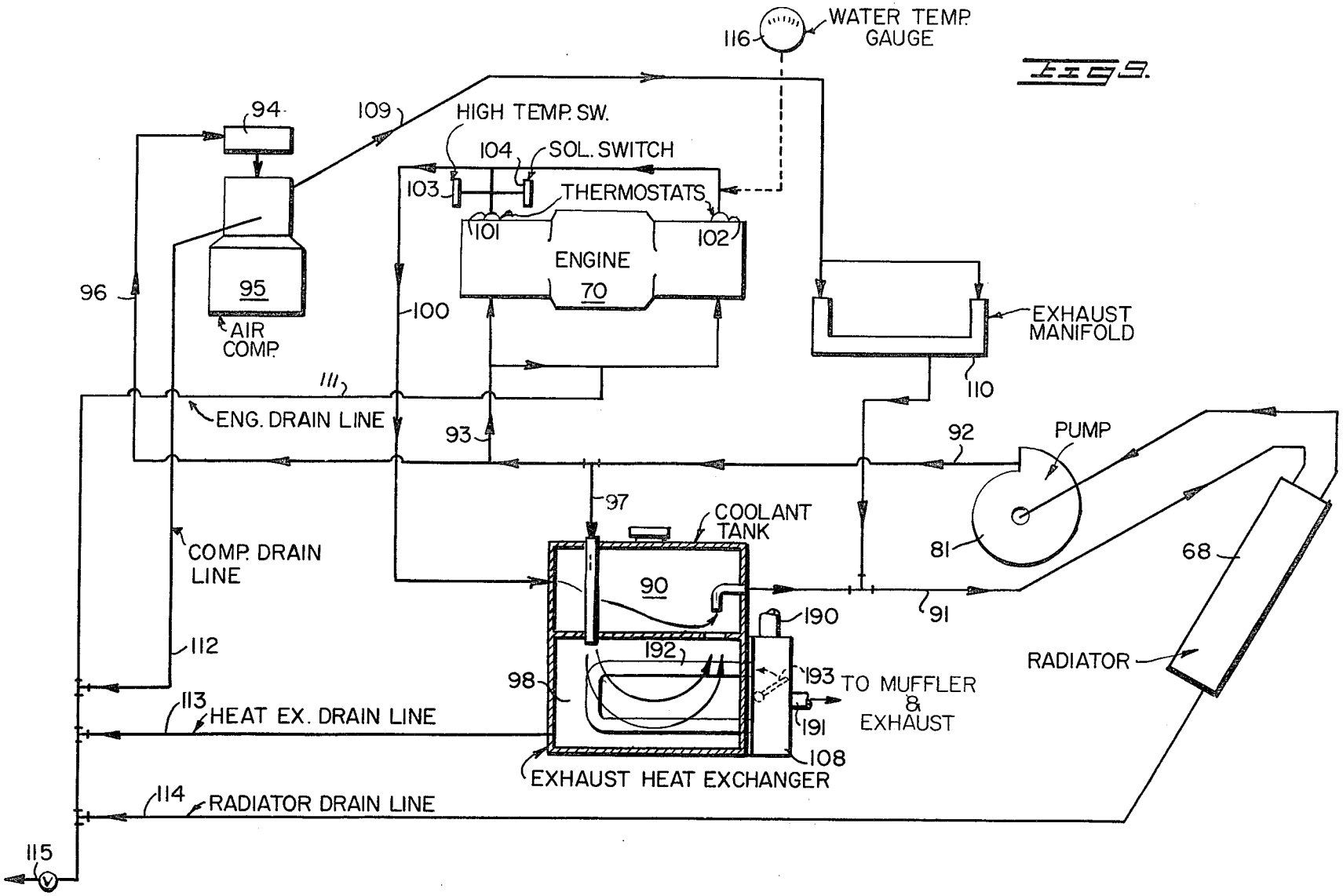
FIG. 9 is a schematic diagram of the engine and air compressor cooling system and heat exchange system.
Figure 17:
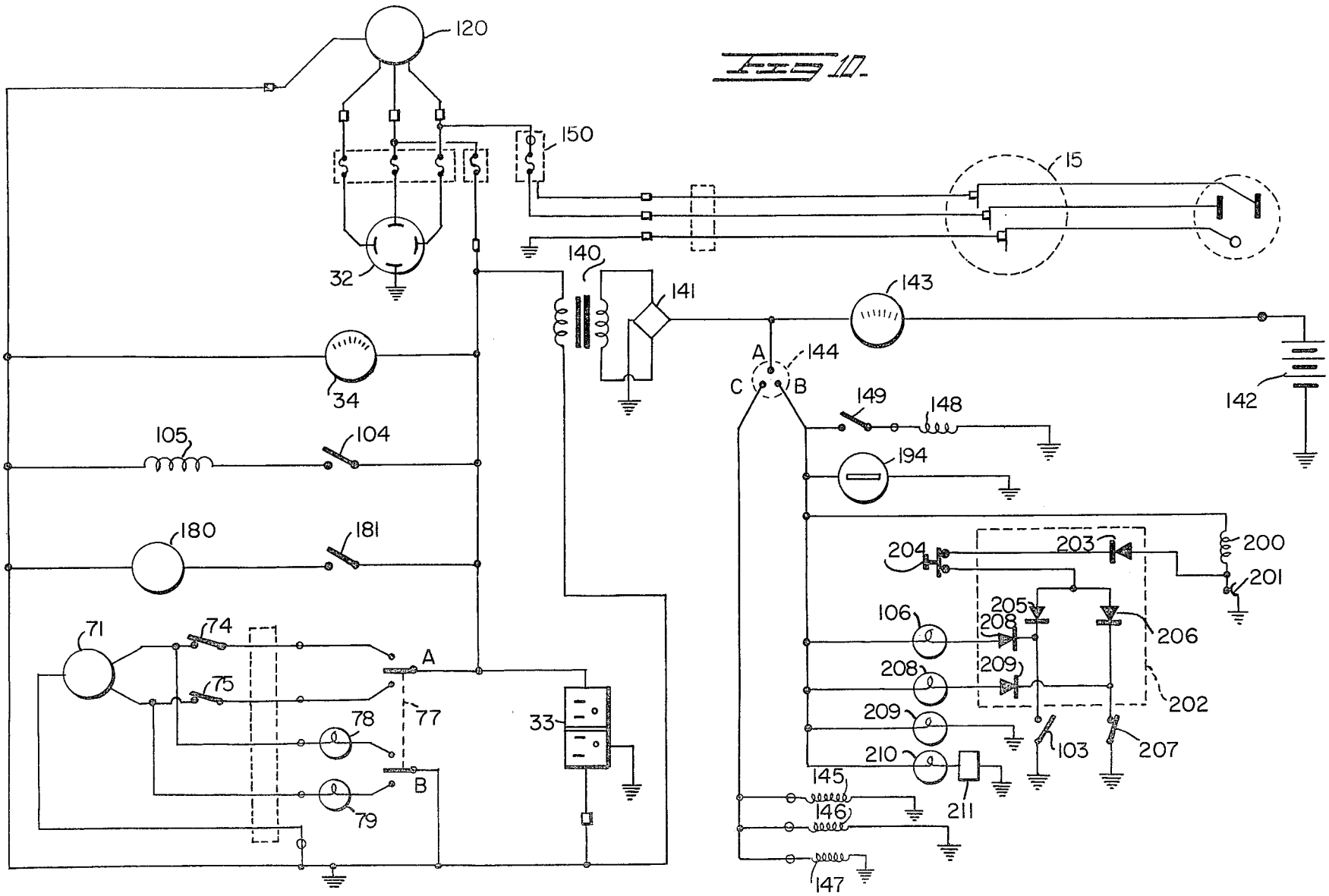

The heat exchanger 68 or radiator provides a means to cool fluid utilized to cool the engine, engine exhaust and air compressor as well as providing a means to heat air for the conditioned air system. FIG. 9 is a schematic of the heat exchange liquid flow for the service module. Coolant pump 81 is driven by the engine of the service module by a V belt 82 which couples the coolant pump pulley 83 to pulley 84 of engine 70, see FIGS. 4 and 6. The crank shaft of engine 70 includes drive shaft means at the front and back of the engine as can be seen in FIG. 6 and identified as 61.

Coolant is stored in the expansion tank 90 which is coupled to the heat exchanger 68 inlet via line 91. Pump 81 draws coolant from the expansion tank 90 through conduit 91 and through heat exchanger 68 and forces the coolant via conduit 92 through the cooling jacket of engine 70 via conduit 93 and the cooling jacket 94 of air compressor 94 via conduit 96. Coolant is also forced from the pump via conduit 92 and conduit 97 through the exhaust heat exchanger 98 then to a muffler for the engine (not shown).

Coolant flow through the engine coolant jacket is returned to the coolant expansion tank 90 via conduit 100 which includes thermostats 101 and 102 which maintain the engine temperature via temperature actuated switches 103 and 104.

The high temperature switch 103 closes when the coolant reaches 225° F. and activates the engine shut down circuit by grounding the ignition system. The switch also turns on a high temperature warning light 106, see FIG. 10.

The solenoid switch 104 is activated when the coolant reaches a temperature of 195° F. This switch energizes solenoid 105 of FIG. 10 which activates heat exchanger baffle 193 causing the exhaust gases to bypass the exhaust heat exchanger tubes in exhaust heat exchanger 98 to minimize the amount of heat rejection which must be accomplished by heat exchanger 68 during warm weather.

The exhaust heat exchanger baffle assembly 108 illustrated in FIG. 9 is comprised of an exhaust duct coupled to the exhaust manifold via exhaust duct 190 and to the muffler and exhaust system by coupling 191. Heat exchanger tubes 192 channel hot exhaust gases from the input side of the duct near 190 to the opposite end of the duct and are positioned in the exhaust heat exchanger so that the cooling fluid may extract heat from the exhaust gases as it circulates. A solenoid actuated flapper 193 is positioned between the inlet for conduit 192 and the outlet for conduit 192 in the exhaust manifold. When the solenoid is not energized, the flapper is in the position illustrated in FIG. 9 and exhaust gases entering at 190 are forced through conduit 192 and out 191. However, when engine coolant temperature exceeds 195° F., the solenoid is energized and flapper 193 is raised. This seals the opening to conduit 192 and permits exhaust gases to flow directly through the manifold from 190 through 191 without passing through the exhaust exchanger.

Coolant flow from conduit 97 to the exhaust exchanger 98 returns to the coolant expansion tank 90 from where it flows through heat exchange radiator 68.

Coolant flow from pump 81 through conduit 92 also flows through conduit 96 to the propane pressure regulator 94 and then through air compressor 95 from where it flows via conduit 109 through the exhaust manifold cooling jacket 110 to the inlet of heat exchange radiator 68 via conduit 91 along with coolant flow from coolant expansion tank 90.

Drain lines 111, 112, 113, and 114 are provided to drain the engine coolant jacket, compressor coolant system, exhaust heat exchanger and coolant buffer tank, and heat exchanger 68 respectively via a common drain valve 115.

The water temperature gauge 116 illustrated in FIG. 9 provides an indication of the coolant temperatures exiting the engine coolant system.

Figure 4:
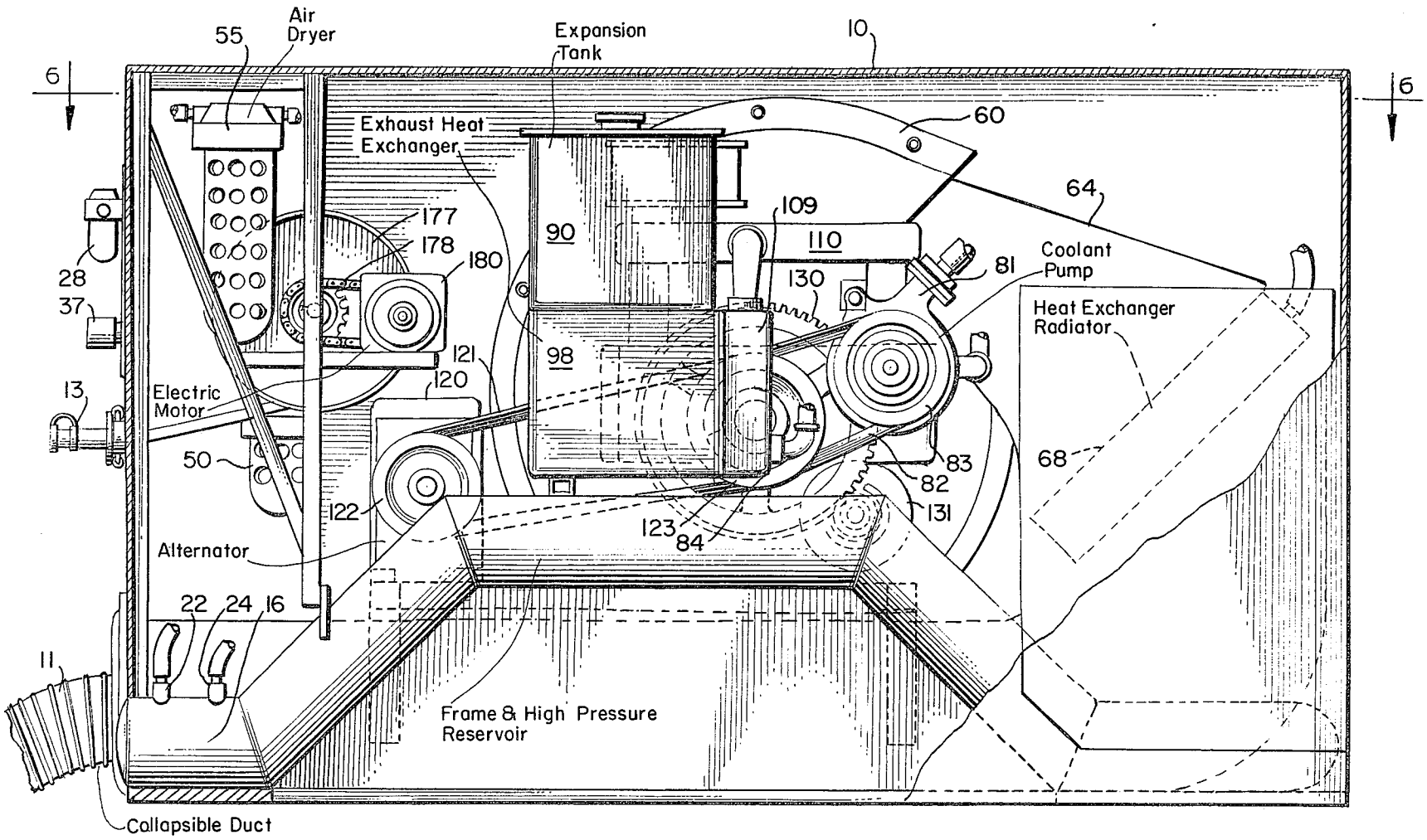
FIG. 4 is a side view of the underground service module with the side panel partially removed to illustrate the exhaust system heat exchanger.
Figure 4:
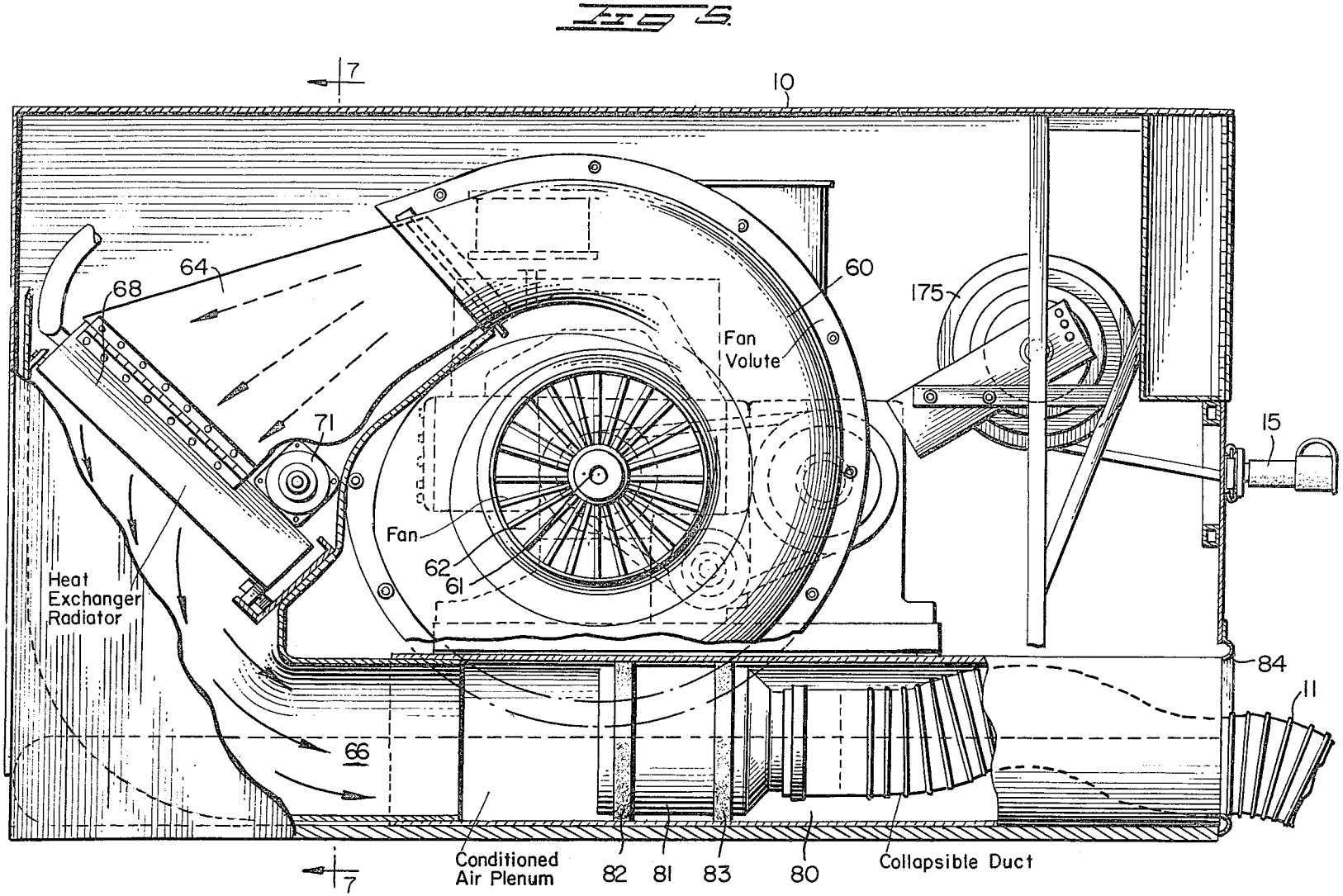

The physical location of the coolant buffer tank 90 and exhaust heat exchanger 98 is depicted in FIG. 4. Note that the exhaust manifold 110 channels exhaust gases to the muffler 109 which is selectively cooled as a function of baffles 108 of FIG. 9 which cause the exhaust gases to pass through the exhaust heat exchanger 98 or, when the temperature exceeds preset limits, to pass directly through the muffler to the exhaust system.

FIG. 4 also illustrates the alternator 120 which is driven by a V belt 121 connecting the alternator pulley 122 to the engine pulley 123 which is coupled to a common shaft with pulley 84 and flywheel 130.

Flywheel 130 includes a gear ring around its periphery which cooperate with starter 131 during the starting sequence. Schematically these components are illustrated in FIG. 10. Note that the alternator 120 is coupled to the three phase outlet plug 32 by circuit breakers and that one phase is coupled to the heat exchange drive motor 71 via a circuit breaker and the A contact set of switches 77. This phase of the alternator also provides alternating current to transformer 140.

The second area of transformer 140 is coupled to a full wave rectifier 141 which provides a DC voltage for charging the starting battery 142. A current meter 143 is provided in the line to indicate the charge condition of the battery.

The starter 131 of FIG. 4 is energized when the starting circuit is enabled by the closure of starter switch 144 of FIG. 10. Starter switch 144 is a standard ignition switch which when placed in the on position provides an electrical circuit between terminal A and terminal B. In the spring loaded start position it also provides an electrical circuit between terminal A and terminal C so long as the key is held in the spring loaded on position. When released, the circuit between A and C opens but the circuit between A and B remains closed.

The C circuit of starter switch 144 includes a Bendix solenoid 145 which energizes the engine starter and causes the starter to rotate and engage the gears on the flywheel of the engine. Also included in this circuit is a primer solenoid 146 which drives an electric fuel pump to prime the engine for initial starting and a fuel lock off override solenoid 147 which opens a fuel lock off valve that is normally held open by manifold pressure once the engine starts.

The B circuit of starter switch 144 provides current to the coil 148 of the magnetic clutch 163 of FIG. 6 via switch 149 to control the operation of the air compressor. With switch 149 in the open position, coil 148 is de-energized and magnetic clutch 163 is disengaged so that V belt 160 will not drive the air compressor pulley 161. However, with the ignition on and switch 149 closed, coil 148 is energized and clutch 163 becomes engaged to drive pulley 162 which in turn drives the air compressor via V belt 160 and pulley 161, see FIG. 6.

An hour meter is connected to the B terminal of ignition switch 144 to record the operating hours of the system.

Ignition coil 220 is energized by a connection to the B terminal of ignition switch 144 and provides high voltage to the ignition system distributor contact points 201. A safety circuit 202 is coupled to the high voltage side of ignition coil 200. This circuit includes a diode 203 which isolates the high voltage side of ignition coil 200 and provides a path to short out or bypass ignition points 201 via the normally closed push-button cut off switch 204, diodes 205 and 206 and switches 103 and 207. Switch 103 is a thermostatic switch responsive to engine coolant temperature as previously explained and it is normally open so that during operation of the system, the ignition distributor 201 cannot be bypassed via pushbutton switch 204, diode 205 and switch 103 to ground. However, when the engine coolant overheats, the normally open switch 103 closes and shorts out the distributor, stopping the engine. This function also creates a path for ground from the B contact of ignition switch 144 through high temperature warning lamp 106 and isolation diode 208. Switch 207 is normally closed and responsive to oil pressure in the engine. Thus it serves as a low oil pressure cut off. During the starting sequence, switch 204 is depressed to disable the automatic cut off circuit 202 and the fact that low oil pressure switch 207 is closed does not prevent starting the engine. However, once the engine is started and oil pressure opens switch 207, switch 204 is released and the engine will run normally. If oil pressure is lost due to some malfunction or the system runs out of oil, switch 207 will close and the distributor 201 will be bypassed causing the engine to cease functioning. When switch 207 closes the low pressure oil light 208 is illuminated through the B circuit of ignition switch 144 and isolation diode 209. During the starting sequence, normally closed push-button 204 is held in the open position until the low pressure oil light 208 extinguishes, signifying that oil pressure has built up to a point where the low oil pressure switch 207 has opened.

The B circuit of ignition switch 144 also includes a pilot lamp 209 which indicates that the ignition is on and a low oil level warning lamp 210 which is coupled to ground via a oil level sensor 211 contained in the crank case of the engine.

One phase of the alternator output is coupled to a ground fault circuit breaker 150 to the electrical extension 15. A second electrical connection from the common phase is also coupled to reel brushes 15 and a ground is provided as illustrated in FIG. 10.

Electrical extension 15, low pressure air line 12 and high pressure air line 13 are stored on cable reels 175, 176, and 177 of FIG. 6 respectively. These reels are driven via a slip clutch means for each individual reel which is powered from a common shaft 178 that is driven via a chain drive 179 coupled to an electric motor 180, see also FIG. 4. Electric motor 180 is controlled by switch means 181 on the front panel of the service module and schematically illustrated in FIG. 10.

While preferred embodiments of this invention have been illustrated and described, variations and modifications may be apparent to those skilled in the art. Therefore, I do not wish to be limited thereto and ask that the scope and breadth of this invention be determined from the claims which follow rather than the above description.

What I claim is:

1. A service module, comprising:

a liquid cooled internal combustion engine;

a liquid cooled air compressor driven by said internal combustion engine;

an exhaust conduit for removing exhaust gases from said liquid cooled internal combustion engine;

a liquid reservoir;

a liquid circuit coupling liquid between said liquid cooled internal combustion engine, said liquid cooled air compressor and said liquid reservoir;

a heat exchange gas duct positioned in said liquid reservoir in heat exchange relationship with said liquid; and an exhaust gas deflector positioned in said exhaust conduit responsive to the temperature of said liquid exiting said liquid cooled internal combustion engine for selectively deflecting exhaust gas through said heat exchange gas duct.

2. A service module as defined in claim 1, further comprising;

a ventilating blower driven by said internal combustion engine.

3. A service module as defined in claim 2, comprising:

a ventilating blower duct coupled to the output of said ventilating blower and including a conditioned air outlet duct and an exhaust duct;

a heat exchange radiator in said liquid circuit; and means to support said heat exchange radiator in said ventilating blower duct including a wormgear for selectively transporting said heat exchange radiator between said conditioned air outlet duct and said exhaust duct for controlling the temperature of air exiting said conditioned air outlet duct.

4. A service module as defined in claim 3, comprising:

a variable air inlet for said ventilating blower for controlling the volume of air exiting said conditioned air outlet duct and said exhaust duct.

5. A service module as defined in claim 4, comprising:

an ignition circuit for said internal combustion engine;

a thermally responsive switch positioned in said liquid circuit; and ignition circuit interrupt means responsive to said thermally responsive switch for stopping said internal combustion engine when the temperature of said liquid in said liquid circuit exceeds a predetermined value.

6. A service module as defined in claim 5, comprising:

an oil pressure responsive switch responsive to the oil pressure of said internal combustion engine;

a second interrupt switch in said ignition circuit for interrupting said ignition circuit to stop said internal combustion engine whenever the oil pressure in said internal combustion engine falls below a predetermined value; and bypass means for bypassing said second interrupt switch during the initial starting phase of said internal combustion engine.

7. A service module as defined in claim 6, comprising:

a high pressure manifold pressurized by said liquid cooled air compressor; a high pressure air supply system coupled to said high pressure manifold, said high pressure air supply system including a high pressure regulator; and a low pressure air supply system coupled to said high pressure manifold, said low pressure air supply system including a low pressure regulator.

8. A service module as defined in claim 7, comprising:

a belt drive system coupling said liquid cooled internal combustion engine to said liquid cooled air compressor; and a magnetic clutch for selectively engaging said belt drive system.

9. A service module as defined in claim 8, comprising:

an alternator driven by said liquid cooled internal combustion engine; and electrical outlet means for providing current generated by said alternator to a remote location.

* * * * *